US008083164B2

(12) United States Patent
Johnson et al.

(10) Patent No.: US 8,083,164 B2
(45) **Date of Patent: *Dec. 27, 2011**

(54) EXIT VALVE FOR BLOWING WOOL MACHINE

(75) Inventors: Michael W. Johnson, Lithopolis, OH (US); Michael E. Evans, Granville, OH (US); Agustin Hernandez, Blacklick, OH (US); Robert J. O'Leary, Newark, OH (US); Christopher M. Relyea, Columbus, OH (US); Brian K. Linstedt, Ostrander, OH (US); Gregory J. Merz, Gahanna, OH (US); Charles R. McKean, Mt. Vernon, OH (US)

(73) Assignee: Owens Corning Fiberglas Technology, Summit, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/707,760

(22) Filed: Feb. 18, 2010

(65) Prior Publication Data

US 2010/0219272 A1 Sep. 2, 2010

Related U.S. Application Data

(63) Continuation of application No. 11/581,660, filed on Oct. 16, 2006, now Pat. No. 7,712,690.

(51) Int. Cl.
*B02C 23/20* (2006.01)

(52) U.S. Cl. ..... 241/60

(58) Field of Classification Search ..... 241/29, 241/60, 277, 278.1, 278.2, 283, 134, 141, 241/98, 136

See application file for complete search history.

(56) References Cited

U.S. PATENT DOCUMENTS

| | | | | |
|---|---|---|---|---|
| 2,721,767 | A * | 10/1955 | Kropp | 406/101 |
| 2,989,252 | A * | 6/1961 | Babb | 241/138 |
| 4,151,962 | A * | 5/1979 | Calhoun et al. | 241/60 |
| 7,712,690 | B2 * | 5/2010 | Johnson et al. | 241/60 |
| 7,731,115 | B2 * | 6/2010 | Johnson et al. | 241/101.8 |

FOREIGN PATENT DOCUMENTS

GB 2124194 A 2/1984

* cited by examiner

*Primary Examiner* — Dana Ross
*Assistant Examiner* — Matthew G Katcoff
(74) *Attorney, Agent, or Firm* — MacMillan, Sobanski & Todd, LLC

(57) ABSTRACT

A machine for distributing blowing insulation from a bag of compressed blowing insulation is provided. The machine includes a chute having an inlet end configured to receive the bag of compressed blowing insulation. A shredding chamber is associated with the chute. The shredding chamber includes a plurality of shredders configured to shred and pick apart the blowing insulation. The shredding chamber further includes a discharge mechanism mounted for rotation and configured for distributing the blowing insulation into an airstream. The discharge mechanism has a side inlet and includes sealing vane assemblies having vane tips. Rotation of the vane tips forms an arc. The blowing insulation is fed horizontally from the shredding chamber into the side inlet of the discharge mechanism in a manner such that the blowing insulation passes through the arc formed by the rotating vane tips.

12 Claims, 6 Drawing Sheets

EXIT VALVE FOR BLOWING WOOL MACHINE

RELATED APPLICATIONS

This application is a continuation patent application of pending U.S. patent application Ser. No. 11/581,660, filed Oct. 16, 2006, the disclosure of which is incorporated herein by reference.

TECHNICAL FIELD

This invention relates to loosefil insulation for insulating buildings. More particularly this invention relates to machines for distributing packaged loosefil insulation.

BACKGROUND OF THE INVENTION

In the insulation of buildings, a frequently used insulation product is loosefil insulation. In contrast to the unitary or monolithic structure of insulation batts or blankets, loosefil insulation is a multiplicity of discrete, individual tufts, cubes, flakes or nodules. Loosefil insulation is usually applied to buildings by blowing the insulation into an insulation cavity, such as a wall cavity or an attic of a building. Typically loosefil insulation is made of glass fibers although other mineral fibers, organic fibers, and cellulose fibers can be used.

Loosefil insulation, commonly referred to as blowing wool, is typically compressed in packages for transport from an insulation manufacturing site to a building that is to be insulated. Typically the packages include compressed blowing wool encapsulated in a bag. The bags are made of polypropylene or other suitable material. During the packaging of the blowing wool, it is placed under compression for storage and transportation efficiencies. Typically, the blowing wool is packaged with a compression ratio of at least about 10:1. The distribution of blowing wool into an insulation cavity typically uses a blowing wool distribution machine that feeds the blowing wool pneumatically through a distribution hose. Blowing wool distribution machines typically have a large chute or hopper for containing and feeding the blowing wool after the package is opened and the blowing wool is allowed to expand.

It would be advantageous if blowing wool machines could be improved to make them easier to use.

SUMMARY OF THE INVENTION

The above objects as well as other objects not specifically enumerated are achieved by a machine for distributing blowing insulation from a bag of compressed blowing insulation. The machine includes a chute having an inlet end configured to receive the bag of compressed blowing insulation. A shredding chamber is associated with the chute. The shredding chamber includes a plurality of shredders configured to shred and pick apart the blowing insulation. The shredding chamber further includes a discharge mechanism mounted for rotation and configured for distributing the blowing insulation into an airstream. The discharge mechanism has a side inlet and includes sealing vane assemblies having vane tips. Rotation of the vane tips forms an arc. The blowing insulation is fed horizontally from the shredding chamber into the side inlet of the discharge mechanism in a manner such that the blowing insulation passes through the arc formed by the rotating vane tips.

According to this invention there is also provided a machine for distributing blowing insulation from a bag of compressed blowing insulation. The machine includes a chute having an inlet end configured to receive the bag of compressed blowing insulation. A shredding chamber is associated with the chute. The shredding chamber includes a plurality of shredders configured to shred and pick apart the blowing insulation. The shredding chamber further includes a discharge mechanism mounted for rotation and configured for distributing the blowing insulation into an airstream. The discharge mechanism has a side inlet and includes sealing vane assemblies mounted to a valve shaft. The valve shaft has a major axis. The blowing insulation is fed in a horizontal direction from the shredding chamber into the side inlet of the discharge mechanism, with the horizontal direction being substantially perpendicular to the major axis of the valve shaft.

According to this invention there is also provided a machine for distributing blowing insulation from a bag of compressed blowing insulation. The machine includes a chute having an inlet end configured to receive the bag of compressed blowing insulation. A shredding chamber is associated with the chute. The shredding chamber includes a plurality of shredders configured to shred and pick apart the blowing insulation. The shredding chamber further includes a discharge mechanism mounted for rotation and configured for distributing the blowing insulation into an airstream. The discharge mechanism has a side inlet and includes sealing vane assemblies having vane tips and a valve shaft. The blowing insulation is fed in a horizontal direction from the shredding chamber into the side inlet of the discharge mechanism in a manner such that the blowing insulation feeds radially inward from the vane tips to the valve shaft.

Various objects and advantages of this invention will become apparent to those skilled in the art from the following detailed description of the preferred embodiment, when read in light of the accompanying drawings.

DETAILED DESCRIPTION OF THE INVENTION

Figure 1:
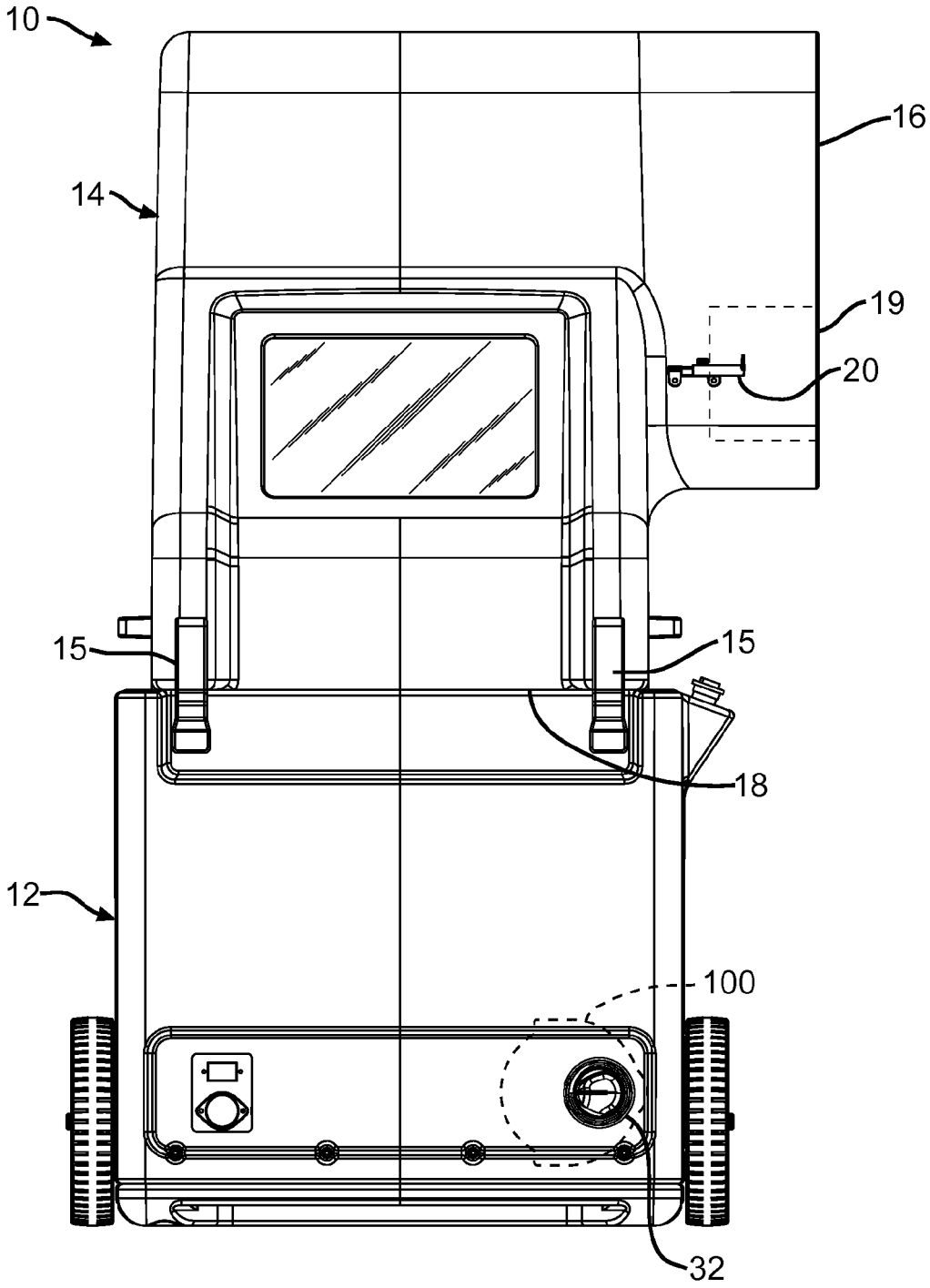
FIG. 1 is a front view in elevation of an insulation blowing wool machine.
Figure 2:
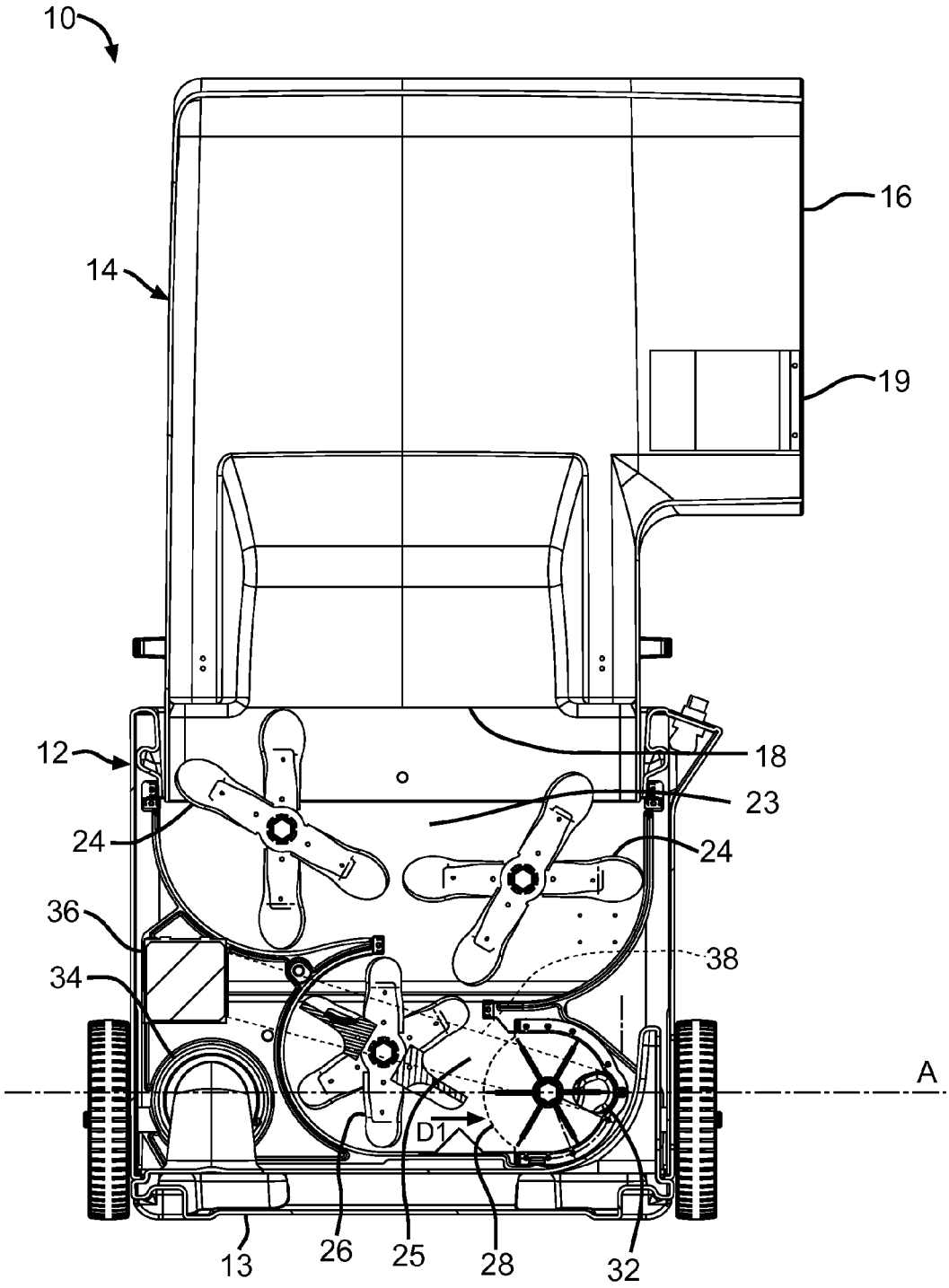
FIG. 2 is a front view in elevation, partially in cross-section, of the insulation blowing wool machine of FIG. 1.
Figure 3:
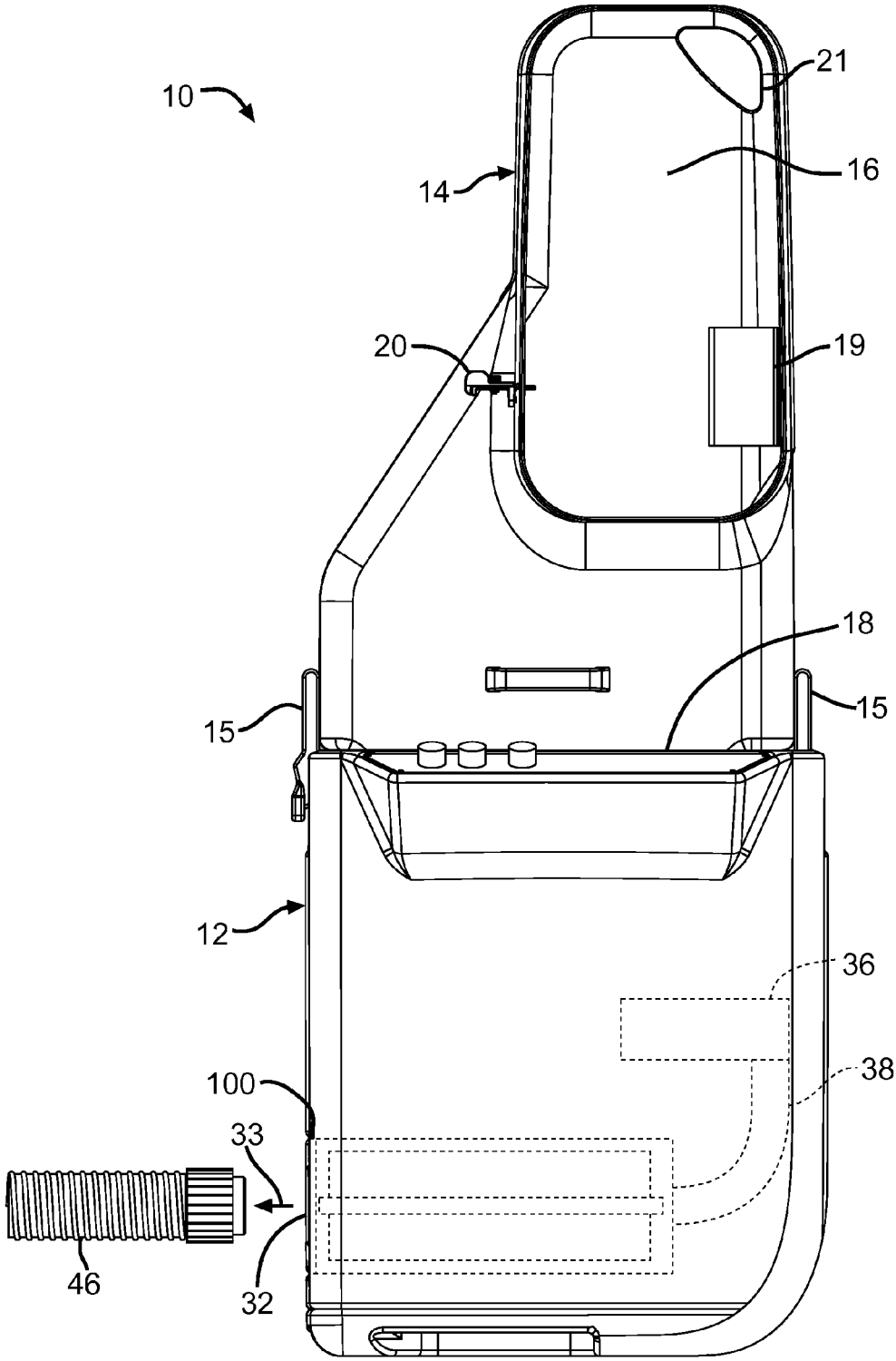
FIG. 3 is a side view in elevation of the insulation blowing wool machine of FIG. 1.

A blowing wool machine 10 for distributing compressed blowing wool is shown in FIGS. 1-3. The blowing wool machine 10 includes a lower unit 12 and a chute 14. The lower unit 12 is connected to the chute 14 by a plurality of fastening mechanisms 15 configured to readily assemble and disassemble the chute 14 to the lower unit 12. As further shown in FIGS. 1-3, the chute 14 has an inlet end 16 and an outlet end 18.

The chute 14 is configured to receive the blowing wool and introduce the blowing wool to the shredding chamber 23 as shown in FIG. 2. Optionally, the chute 14 includes a handle segment 21, as shown in FIG. 3, to facilitate ready movement of the blowing wool machine 10 from one location to another. However, the handle segment 21 is not necessary to the operation of the machine 10.

As further shown in FIGS. 1-3, the chute 14 includes an optional guide assembly 19 mounted at the inlet end 16 of the chute 14. The guide assembly 19 is configured to urge a package of compressed blowing wool against a cutting mechanism 20, shown in FIGS. 1 and 3, as the package moves into the chute 14.

As shown in FIG. 2, the shredding chamber 23 is mounted at the outlet end 18 of the chute 14. In this embodiment, the shredding chamber 23 includes a plurality of low speed shredders 24 and an agitator 26. The low speed shredders 24 shred and pick apart the blowing wool as the blowing wool is discharged from the outlet end 18 of the chute 14 into the lower unit 12. Although the blowing wool machine 10 is shown with a plurality of low speed shredders 24, any type of separator, such as a clump breaker, beater bar or any other mechanism that shreds and picks apart the blowing wool can be used.

As further shown in FIG. 2, the shredding chamber 23 includes an agitator 26 for final shredding of the blowing wool and for preparing the blowing wool for distribution into an airstream. In this embodiment as shown in FIG. 2, the agitator 26 is positioned beneath the low speed shredders 24. Alternatively, the agitator 26 can be disposed in any location relative to the low speed shredders 24, such as horizontally adjacent to, sufficient to receive the blowing wool from the low speed shredders 24. In this embodiment, the agitator 26 is a high speed shredder. Alternatively, any type of shredder can be used, such as a low speed shredder, clump breaker, beater bar or any other mechanism that finely shreds the blowing wool and prepares the blowing wool for distribution into an airstream.

In this embodiment, the low speed shredders 24 rotate at a lower speed than the agitator 26. The low speed shredders 24 rotate at a speed of about 40-80 rpm and the agitator 26 rotates at a speed of about 300-500 rpm. In another embodiment, the low speed shredders 24 can rotate at speeds less than or more than 40-80 rpm and the agitator 26 can rotate at speeds less than or more than 300-500 rpm.

Referring again to FIG. 2, a discharge mechanism 28 is positioned adjacent to the agitator 26 and is configured to distribute the finely shredded blowing wool into the airstream. In this embodiment, the shredded blowing wool is driven through the discharge mechanism 28 and through a machine outlet 32 by an airstream provided by a blower 36 mounted in the lower unit 12. The airstream is indicated by an arrow 33 in FIG. 3. In another embodiment, the airstream 33 can be provided by another method, such as by a vacuum, sufficient to provide an airstream 33 driven through the discharge mechanism 28. In this embodiment, the blower 36 provides the airstream 33 to the discharge mechanism 28 through a duct 38 as shown in FIG. 2. Alternatively, the airstream 33 can be provided to the discharge mechanism 28 by another structure, such as by a hose or pipe, sufficient to provide the discharge mechanism 28 with the airstream 33.

The shredders 24, agitator 26, discharge mechanism 28 and the blower 36 are mounted for rotation. They can be driven by any suitable means, such as by a motor 34, or other means sufficient to drive rotary equipment. Alternatively, each of the shredders 24, agitator 26, discharge mechanism 28 and the blower 36 can be provided with its own motor.

In operation, the chute 14 guides the blowing wool to the shredding chamber 23. The shredding chamber 23 includes the low speed shredders 24 which shred and pick apart the blowing wool. The shredded blowing wool drops from the low speed shredders 24 into the agitator 26. The agitator 26 prepares the blowing wool for distribution into the airstream 33 by further shredding the blowing wool. The finely shredded blowing wool exits the agitator 26 at an outlet end 25 of the shredding chamber 23 and enters the discharge mechanism 28 for distribution into the airstream 33 provided by the blower 36. The airstream 33, with the shredded blowing wool, exits the machine 10 at the machine outlet 32 and flows through the distribution hose 46, as shown in FIG. 3, toward the insulation cavity, not shown.

Figure 4:
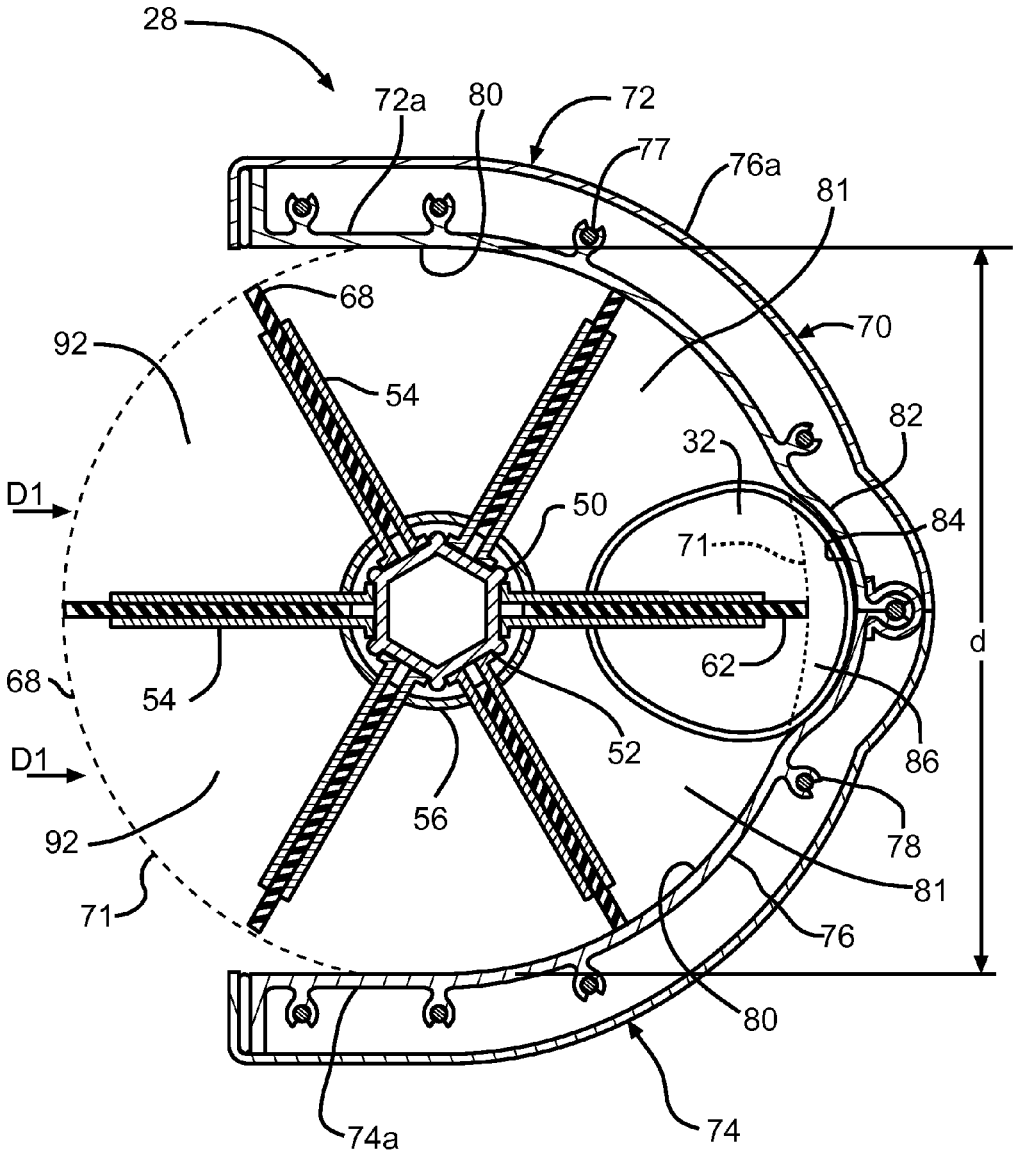
FIG. 4 is a cross-sectional view in elevation of a discharge mechanism of the insulation blowing wool machine of FIG. 1.

As previously discussed and as shown in FIG. 4, the discharge mechanism 28 is configured to distribute the finely shredded blowing wool into the airstream 33. In this embodiment, the discharge mechanism 28 is a rotary valve. Alternatively the discharge mechanism 28 can be any other mechanism including staging hoppers, metering devices, rotary feeders, sufficient to distribute the shredded blowing wool into the airstream 33.

As shown in FIG. 4, the discharge mechanism 28 includes a valve shaft 50 mounted for rotation. In this embodiment, the valve shaft 50 is a hollow rod having a hexagonal cross-sectional shape. The valve shaft 50 is configured with flat hexagonal surfaces 52 which are used to seat a plurality of sealing vane assemblies 54. Alternatively, other cross-sectional shapes, such as a pentagonal cross-sectional shape, can be used.

In this embodiment the valve shaft 50 is made of steel, although the valve shaft 50 can be made of other materials, such as aluminum or plastic, or other materials sufficient to allow the valve shaft 50 to rotate with the seated sealing vane assemblies 54.

Figure 5:
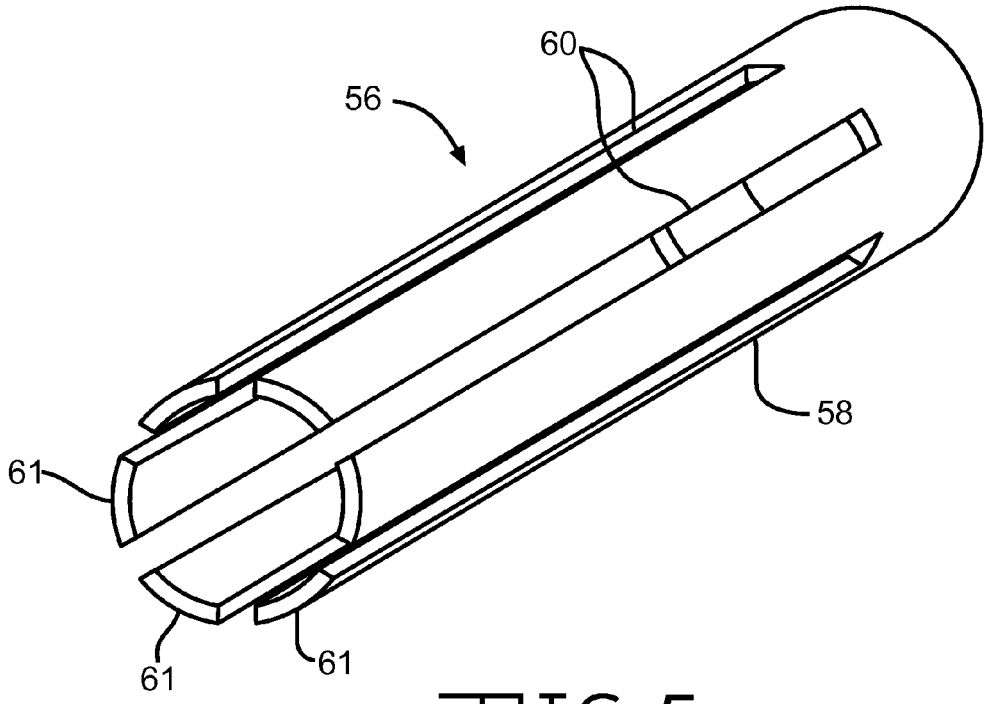
FIG. 5 is a perspective view of a shaft lock of the insulation blowing wool machine of FIG. 1.

A plurality of sealing vane assemblies 54 are attached to the valve shaft 50 by positioning them against the flat hexagonal surface 52 of the valve shaft 50 and holding them in place by a shaft lock 56. In this embodiment as shown in FIG. 5, the shaft lock 56 includes a shaft tube 58 having a plurality of slots 60 and alternate tangs 61. The slots 60 and alternate tangs 61 extend substantially along the length of the shaft lock 56. As will be discussed in more detail later, the slot 60 of the shaft lock 56 slides onto the sealing vane assembly 54 and thereby seats the sealing vane assembly 54 against the hexagonal surfaces 52 of the valve shaft 50. In another embodiment, the valve shaft 50 and the shaft lock 56 may be a single member, such as an extrusion, such that the slots 60 slide onto the sealing vane assembly 54 and are thereby seated against the hexagonal surfaces 52 of the valve shaft. In this embodiment, the shaft lock 56 includes a tube having a plurality of slots 60 and alternate tangs 61. Alternatively, the sealing vane assemblies 54 could be attached to the valve shaft 50 by other fastening mechanisms, such as clamps, clips, bolts, sufficient to attach the sealing vane assemblies 54 to the valve shaft 50. In this embodiment, the sealing vane assemblies 54 are seated against flat hexagonal surfaces 52 of the valve shaft 50 and fixed by the shaft lock 56. In operation, the machine operator can remove the sealing vane assemblies 54, the valve shaft 50 and the shaft lock 56 from the discharge mechanism 28 as a unit, thereby making maintenance and repair simpler.

Figure 6:
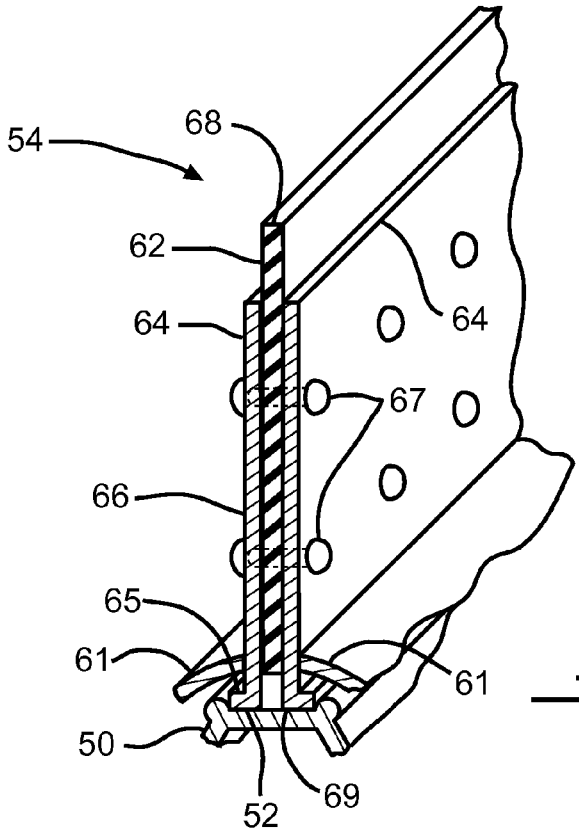
FIG. 6 is a perspective view of a sealing vane assembly of the blowing wool machine of FIG. 1.

As previously mentioned, the discharge mechanism 28 includes a plurality of sealing vane assemblies 54. As shown in FIG. 6, the sealing vane assemblies 54 include a sealing core 62 disposed between two opposing vane supports 64. The sealing core 62 includes a vane tip 68 positioned at the outward end of the sealing core 62. As shown in FIG. 4, the sealing vane assembly 54 is configured such that the vane tip 68 seals against a valve housing 70 as the sealing vane assembly 54 rotates within the valve housing 70. In this embodiment, the sealing core 62 is made from fiber-reinforced rubber. In another embodiment, the sealing core 62 can be made of other materials, such as polymer, silicone, felt, or other materials sufficient to seal against the valve housing 70. In this embodiment, the fiber-reinforced sealing core 62 has a hardness rating of about 50 A to 70 A as measured by a Durometer. The hardness rating of about 50 A to 70 A allows the sealing core 62 to efficiently seal against the valve housing 70 as the sealing vane assembly 54 rotates within the valve housing 70.

As further shown in FIG. 6, each vane support 64 includes a vane support base 65 and a vane support flange 66. The vane support bases 65 of the opposing vane supports 64 combine to form a T-shaped base 69 for each sealing vane assembly 54. As previously discussed, the T-shaped base 69 seats on the flat hexagonal surface 52 of the valve shaft 50. The tangs 61 of the shaft lock 56 hold the T-shaped base 69 of the sealing vane assembly 54 against the hexagonal surface 52 of the valve shaft 50.

In this embodiment as shown in FIG. 6, the sealing core 62 is attached to the vane support flanges 66 by a plurality of vane rivets 67. Alternatively, the sealing core 62 can be attached to the vane support flanges 66 by sonic welding, adhesives, mechanical fasteners, or other fastening methods sufficient to attach the sealing core 62 to the vane support flanges 66. As shown in FIG. 6, the vane support flanges 66 are made of ABS plastic. In another embodiment, the vane support flanges 66 can be made of other materials, including extruded aluminum or brass, sufficient to support the sealing core 62 as the sealing vane assembly 54 rotates within the valve housing 70.

Referring again to FIG. 4, the sealing vane assemblies 54, attached to the valve shaft 50 by the shaft lock 56, rotate within the valve housing 70. In this embodiment, the valve housing 70 is made from an aluminum extrusion, although the valve housing 70 can be made from other materials, including brass or plastic, sufficient to form a housing within which sealing vane assemblies 54 rotate. In this embodiment as shown in FIG. 4, the valve housing 70 includes a top housing segment 72 and a bottom housing segment 74. In another embodiment, the valve housing 70 can be made of a single segment or the valve housing 70 can be made of more than two segments.

As shown in FIG. 4, the valve housing includes an inner housing wall 76 and an optional outer housing wall 76*a*. The inner housing wall 76 has an inner housing surface 80. In this embodiment, the inner housing surface 80 is coated with a chromium alloy to provide a low friction and extended wear surface. Alternatively, the inner housing surface 80 may not be coated with a low friction and extended wear surface or the inner housing surface 80 may be coated with other materials, such as a nickel alloy, sufficient to provide a low friction, extended wear surface.

The top housing segment 72 and the bottom housing segment 74 are attached to the lower unit 12 by housing fasteners 78. In this embodiment, the housing fasteners 78 are bolts extending through mounting holes 77 disposed in the top housing segment 72 and the bottom housing segment 74. In another embodiment, the top housing segment 72 and the bottom housing segment 74 can be attached to the lower unit 12 by other mechanical fasteners, such as clips or clamps, or by other fastening methods including sonic welding or adhesive.

In this embodiment as shown in FIG. 4, the valve housing 70 is curved and extends to form an approximate semi-circular shape. The semi-circular shape of the valve housing 70 has an approximate inside diameter d which is approximately the same diameter as the diameter of an arc 71 formed by the vane tips 68 of the rotating sealing vane assemblies 54. In operation, the vane tips 68 of the sealing vane assemblies 54 seal against the inner housing surface 80 such that finely shredded blowing wool entering the discharge mechanism 28 is contained within a wedge-shaped space 81 defined by adjacent sealing vane assemblies 54 and the inner housing surface 80.

Figure 7:
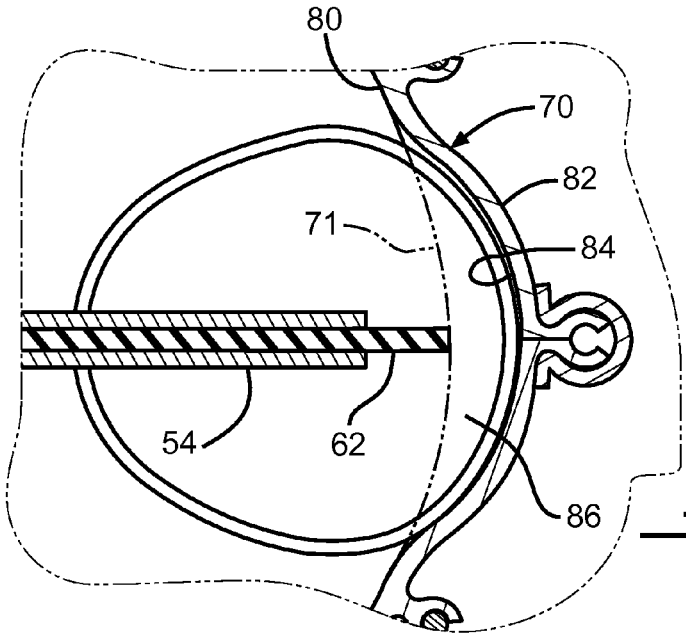
FIG. 7 is a cross-sectional view in elevation of the airstream and eccentric region of the blowing wool machine of FIG. 1.

As shown in FIGS. 4 and 7, the valve housing 70 includes an eccentric segment 82. The eccentric segment 82 extends from or bulges out from the semi-circular shape of the top housing segment 72 and the bottom housing segment 74. In this embodiment, the eccentric segment 82 has an approximate cross-sectional shape of a dome. Alternatively, the eccentric segment 82 can have any cross-section shape that extends from the top housing segment 72 and the bottom housing segment 74. The eccentric segment 82 includes an inner eccentric surface 84. As shown in FIG. 7, the eccentric segment 82 forms an eccentric region 86 which is defined as the area bounded by the inner eccentric surface 84 and the arc 71 formed by the vane tips 68 of the rotating sealing vane assemblies 54. The eccentric region 86 is within the airstream 33 flowing through the discharge mechanism 28. In operation, as a sealing vane assembly 54 rotates into the airstream 33, the vane tip 68 of the sealing vane assembly 54 becomes spaced apart from the inner housing surface 80 of the valve housing 70. As the sealing vane assembly 54 further rotates within the eccentric region 86, the airstream 33 flows along the vane tip 68, thereby forcing any particles of blowing wool caught on the vane tip 68 to be blown off. This clearing of the sealing vane assembly 54 prevents a buildup of shredded blowing wool from forming on the sealing vane assembly 54.

Referring again to FIG. 4, the top and bottom housing segments 72 and 74 do not completely enclose the valve housing 70, and valve housing 70 includes a side inlet 92. In this embodiment, the side inlet 92 of the valve housing 70 has an approximate length equal to the diameter d of the valve housing 70. Alternatively, the side inlet 92 of the valve housing 70 can have an approximate length that is more or less than the diameter d of the valve housing 70. As shown in FIG. 4 in this embodiment, the sealing vane assemblies 54, the valve housing 70, the eccentric region 86 and the side inlet 92 of the valve housing 70 are configured such that as the sealing vane assemblies 54 rotate, the vane tips 68 of no more than four sealing vane assemblies 54 are in contact with the valve housing 70 at any given time. The remaining vane tips 68 of the sealing vane assemblies 54 are disposed either in the side inlet 92 of the valve housing 70 or in the eccentric region 86. By limiting the number of sealing vane assemblies 54 in contact with the valve housing 70, the resulting drag on the valve shaft 50 is reduced, thereby enabling a minimizing of the size of the drive motor 34. In another embodiment, the number of eccentric regions 86 and the number of sealing vane assemblies 54, as well as the size of the side inlet 92 can be varied to allow more or less sealing vane assemblies 54 to be in contact the valve housing 70 at a given time.

In this embodiment as further shown in FIG. 4, the top housing segment 72 and the bottom housing segment 74 have optional straight portions 72*a* and 74*a* respectively, extending from the curved portions of the top and bottom housing segments 72 and 74. The straight portions 72*a* and 74*a* are configured such that as the sealing vane assemblies 54 rotate, the vane tips 68 are spaced apart from the straight portions 72*a* and 74*a*. In another embodiment, the top and bottom housing segments 72 and 74 can have extended segments configured in another shape, such as an outwardly extending arc, sufficient to be spaced apart from the vane tips 68 as the sealing vane assemblies 54 rotate.

As previously discussed and as further shown in FIG. 4, the top and bottom housing segments 72 and 74 do not completely enclose the valve housing 70 and the valve housing 70 includes a side inlet 92. The side inlet 92 is configured to receive the finely shredded blowing wool as it is fed from the agitator 26. Positioning the side inlet 92 of the discharge mechanism 28 at the side of the discharge mechanism 28 allows finely shredded blowing wool to be fed approximately horizontally into the discharge mechanism 28. Horizontal feeding of the blowing wool from the agitator 26 to the discharge mechanism 28 is defined to include the feeding of blowing wool in a direction, indicated by the arrows D1, which is substantially parallel to a floor 13 of the lower unit 12 as best shown in FIG. 2. Referring again to FIG. 4, the feeding of the blowing wool from the agitator 26 in the approximately horizontal direction D1 into the discharge mechanism 28, results in the blowing wool passing through the arc 71 formed by the vane tips 68 as the blowing wool enters the discharge mechanism 28. In this manner, the blowing wool entering the discharge mechanism 28 from the agitator 26 is fed into the discharge mechanism 28 in the direction D1 that is substantially perpendicular to the major axis of the valve shaft 50. In other words, the blowing wool entering the discharge mechanism 28 from the agitator 26 is fed radially inward from the vane tips 68 in the direction of the valve shaft 50. Feeding finely shredded blowing wool horizontally into the discharge mechanism 28 allows the discharge mechanism 28 to be positioned at a lower location within the lower unit 12, thereby allowing the blowing wool machine 10 to be more compact. In this embodiment, the agitator 26 is positioned to be adjacent to the side inlet 92 of the discharge mechanism 28. In another embodiment, a low speed shredder 24, or a plurality of shredders 24 or agitators 26, or another mechanism can be adjacent to the side inlet 92, such that finely shredded blowing wool is fed horizontally into the side inlet 92.

Figure 8:
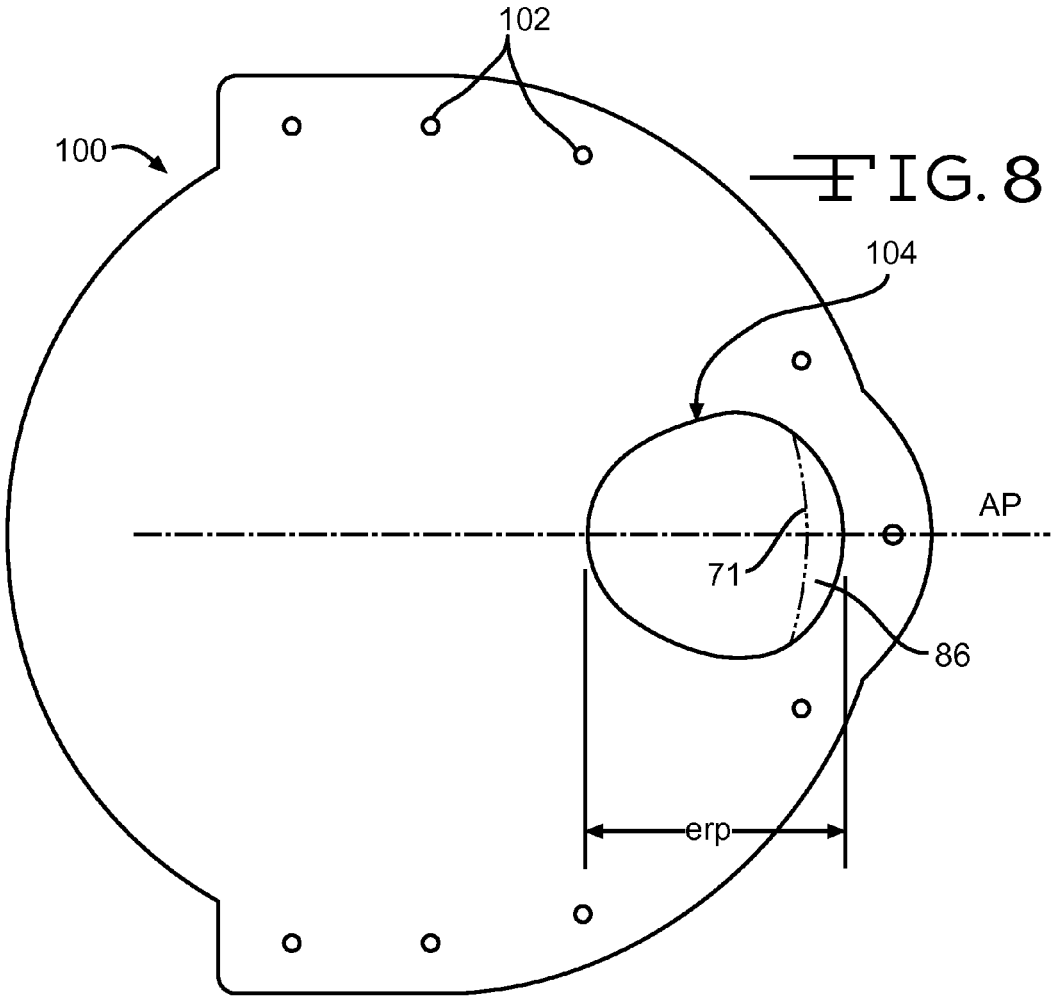
FIG. 8 is a side view in elevation of an end outlet plate of the blowing wool machine of FIG. 1.

The discharge mechanism 28 further includes an end outlet plate 100 as shown in FIGS. 1 and 8. The end outlet plate 100 covers the outlet end of the discharge mechanism 28 at the machine outlet 32. The end outlet plate 100 includes optional mounting holes 102 and an airstream opening 104. In this embodiment, the airstream opening 104 includes the eccentric region 86. In another embodiment, the airstream opening 104 can be any shape sufficient to discharge shredded blowing wool from the discharge mechanism 28.

The principle and mode of operation of this blowing wool machine have been described in its preferred embodiments. However, it should be noted that the blowing wool machine may be practiced otherwise than as specifically illustrated and described without departing from its scope.

What is claimed is:

1. A machine for distributing blowing insulation from a bag of compressed blowing insulation, the machine comprising:

a chute having an inlet end, the inlet end configured to receive the bag of compressed blowing insulation; and a shredding chamber associated with the chute, the shredding chamber including a plurality of shredders configured to shred and pick apart the blowing insulation, the shredding chamber further including a discharge mechanism configured for distributing the blowing insulation into an airstream, the discharge mechanism having a side inlet and including sealing vane assemblies having vane tips, wherein rotation of the vane tips forms an arc;

wherein the blowing insulation is fed horizontally from the shredding chamber into the side inlet of the discharge mechanism in a manner such that the blowing insulation passes through the arc formed by the rotating vane tips, and wherein the discharge mechanism has a housing having a diameter, wherein a vertical length of the side inlet is equal to a diameter of the housing.

2. The machine of claim 1, wherein the shredding chamber includes an agitator, wherein the agitator is disposed adjacent to the side inlet of the discharge mechanism.

3. The machine of claim 2, wherein the agitator disposed adjacent to the side inlet of the discharge mechanism is a high speed agitator.

4. The machine of claim 3, wherein the agitator rotates at a speed of about 300-500 rpm.

5. A machine for distributing blowing insulation from a bag of compressed blowing insulation, the machine comprising:

a chute having an inlet end, the inlet end configured to receive the bag of compressed blowing insulation; and a shredding chamber associated with the chute, the shredding chamber including a plurality of shredders configured to shred and pick apart the blowing insulation, the shredding chamber further including a discharge mechanism configured for distributing the blowing insulation into an airstream, the discharge mechanism having a side inlet and including sealing vane assemblies mounted to a valve shaft, the valve shaft having a major axis;

wherein the blowing insulation is fed in a horizontal direction from the shredding chamber into the side inlet of the discharge mechanism, with the horizontal direction being substantially perpendicular to the major axis of the valve shaft, and wherein the discharge mechanism has a housing having a diameter, wherein a vertical length of the side inlet is equal to a diameter of the housing.

6. The machine of claim 5, wherein the shredding chamber includes an agitator, wherein the agitator is disposed adjacent to the side inlet of the discharge mechanism.

7. The machine of claim 6, wherein the agitator disposed adjacent to the side inlet of the discharge mechanism is a high speed agitator.

8. The machine of claim 7, wherein the agitator rotates at a speed of about 300-500 rpm.

9. A machine for distributing blowing insulation from a bag of compressed blowing insulation, the machine comprising:

a chute having an inlet end, the inlet end configured to receive the bag of compressed blowing insulation; and a shredding chamber associated with the chute, the shredding chamber including a plurality of shredders configured to shred and pick apart the blowing insulation, the shredding chamber further including a discharge mechanism configured for distributing the blowing insulation into an airstream, the discharge mechanism having a side inlet and including sealing vane assemblies having vane tips and a valve shaft;

wherein the blowing insulation is fed in a horizontal direction from the shredding chamber into the side inlet of the discharge mechanism in a manner such that the blowing insulation feeds radially inward from the vane tips to the valve shaft, and wherein the discharge mechanism has a housing having a diameter, wherein a vertical length of the side inlet is equal to a diameter of the housing.

10. The machine of claim 9, wherein the shredding chamber includes an agitator, wherein the agitator is disposed adjacent to the side inlet of the discharge mechanism.

11. The machine of claim 10, wherein the agitator disposed adjacent to the side inlet of the discharge mechanism is a high speed agitator.

12. The machine of claim 11, wherein the agitator rotates at a speed of about 300-500 rpm.

* * * * *